US006674339B2

(12) United States Patent
Kormanyos

(10) Patent No.: US 6,674,339 B2
(45) Date of Patent: Jan. 6, 2004

(54) ULTRA WIDEBAND FREQUENCY DEPENDENT ATTENUATOR WITH CONSTANT GROUP DELAY

(75) Inventor: Brian K. Kormanyos, Kent, WA (US)

(73) Assignee: The Boeing Company, Chicago, IL (US)

( * ) Notice: Subject to any disclaimer, the term of this patent is extended or adjusted under 35 U.S.C. 154(b) by 84 days.

(21) Appl. No.: 09/949,513

(22) Filed: Sep. 7, 2001

(65) Prior Publication Data

US 2003/0048171 A1 Mar. 13, 2003

(51) Int. Cl.[7] ..... H01P 1/22
(52) U.S. Cl. ..... 333/81 A; 333/161; 333/81 R
(58) Field of Search ..... 333/161, 81 A, 333/81 R, 156, 33, 165, 204

(56) References Cited

U.S. PATENT DOCUMENTS

| | | | | |
|---|---|---|---|---|
| 3,659,233 A | | 4/1972 | Hallford | |
| 3,781,722 A | * | 12/1973 | Pierson | 333/31 R |
| 4,138,637 A | * | 2/1979 | Weinert | 323/74 |
| 4,330,765 A | | 5/1982 | Patukonis | |
| 4,346,315 A | | 8/1982 | Roberts | |
| 4,686,495 A | * | 8/1987 | Kameya | 333/156 |
| 4,716,389 A | | 12/1987 | Gawronski et al. | |
| 5,307,031 A | | 4/1994 | Dick | |
| 5,701,372 A | * | 12/1997 | Magel et al. | 385/24 |

FOREIGN PATENT DOCUMENTS

| | | | |
|---|---|---|---|
| EP | 1020 945 A1 | | 7/2000 |
| JP | 03201603 | | 3/1991 |
| JP | 05304433 | | 11/1993 |
| JP | 0-595223 A2 | * | 4/1994 |

* cited by examiner

*Primary Examiner*—Brian Young
*Assistant Examiner*—John B Nguyen
(74) *Attorney, Agent, or Firm*—Harness, Dickey & Pierce, P.L.C.

(57) ABSTRACT

An ultra wideband, frequency dependent attenuator apparatus for providing a loss which can be matched with a physically longer, given delay line, but yet which provides a much shorter time delay than the physically longer, given delay line with constant group delay. The apparatus is formed by an ordinary microstrip transmission line placed in series with an engineered lossy microstrip transmission line, with both transmission lines being placed on a substrate to effectively form a hybrid microstrip transmission line. The lossy transmission line includes resistive material placed along the opposing longitudinal edges thereof. In one embodiment, spaced apart metal tracks are formed along each strip of resistive material to provide the lossy microstrip transmission line with a desired loss characteristic. The apparatus can be used as one element in a delay bank to provide a loss which is matched to an associated delay line having a longer physical length, but which still provides a shorter time delay than the longer delay line with a constant group delay.

15 Claims, 5 Drawing Sheets

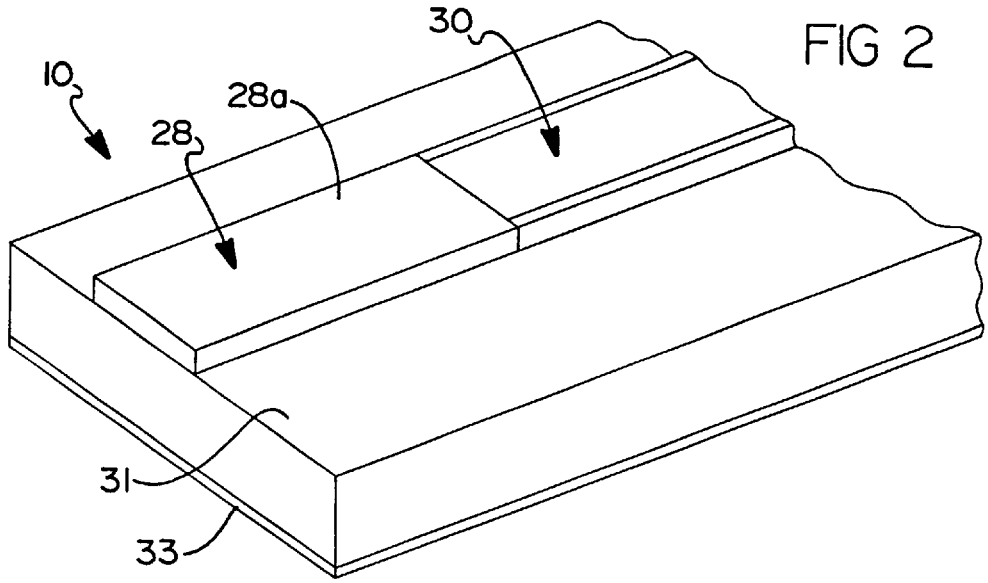
FIG 2
FIG 3
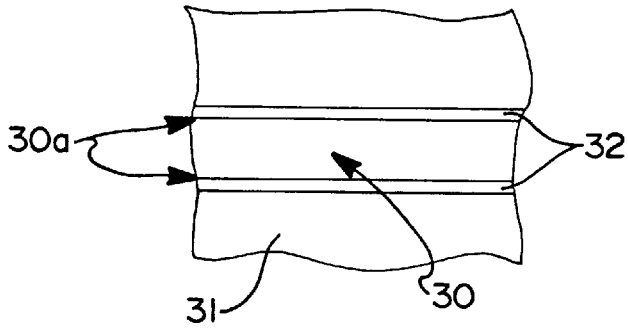
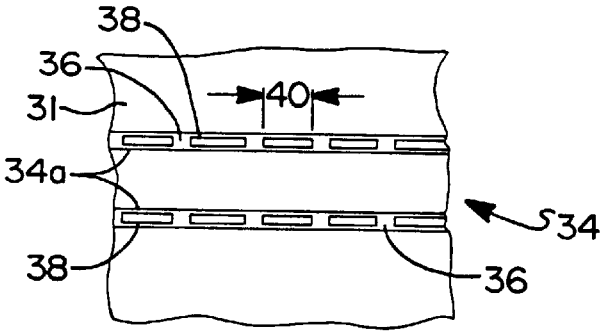
FIG 4

FIG 6
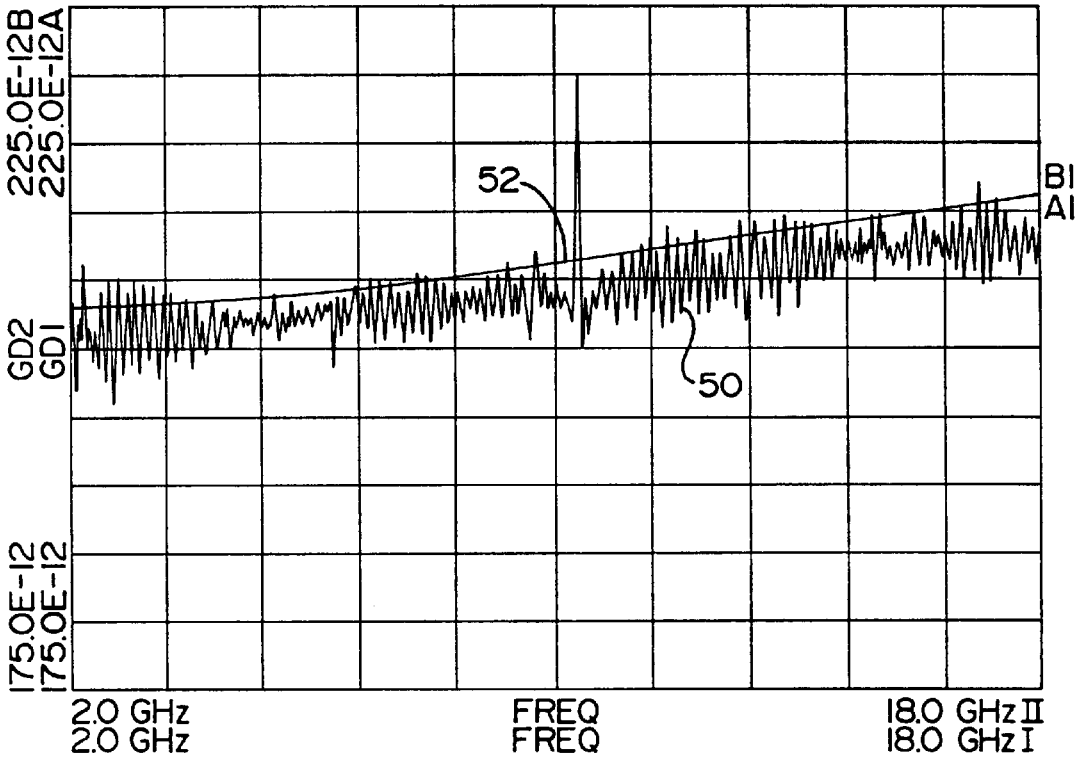
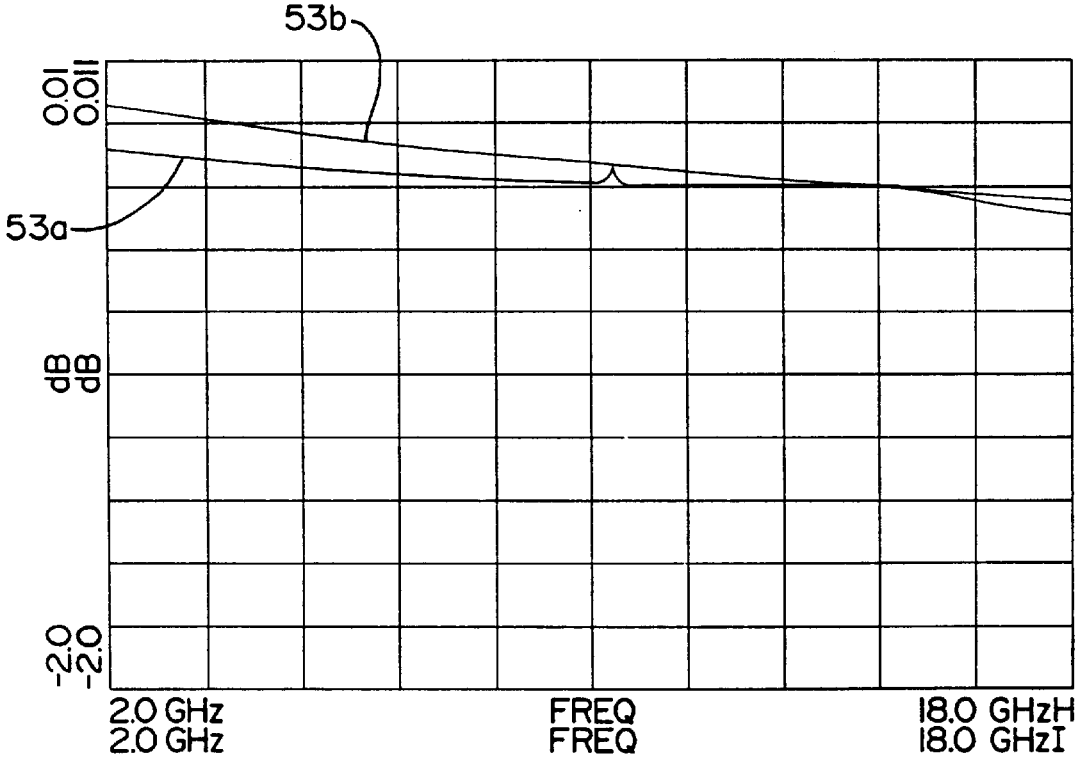
FIG 7

FIG 8
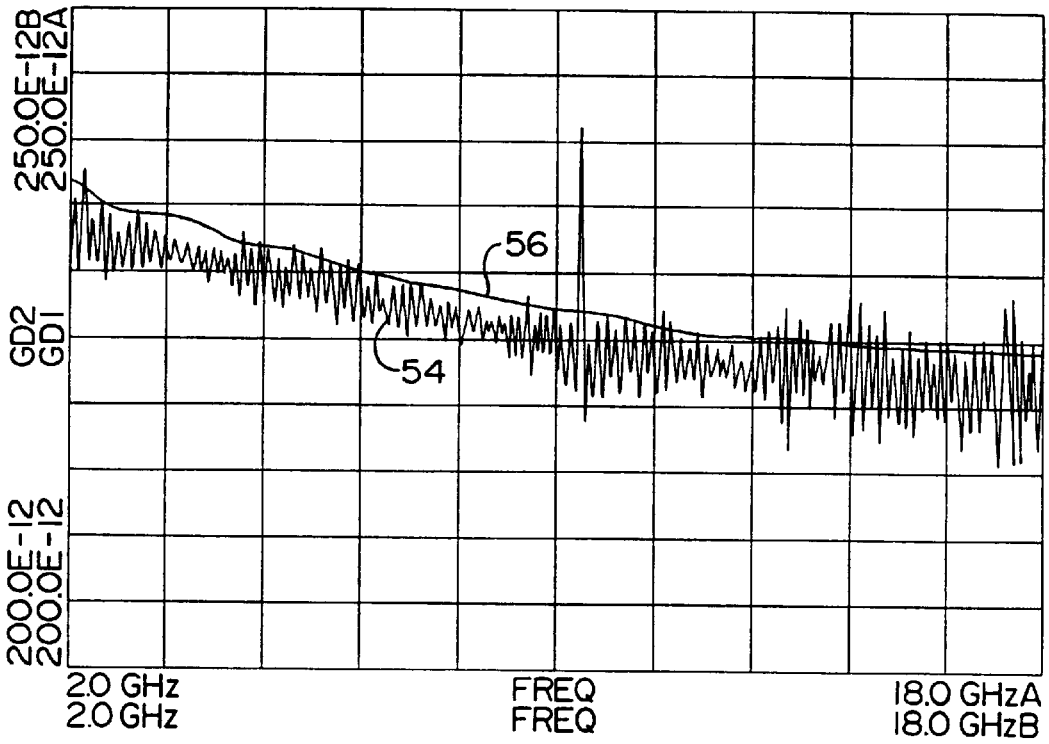
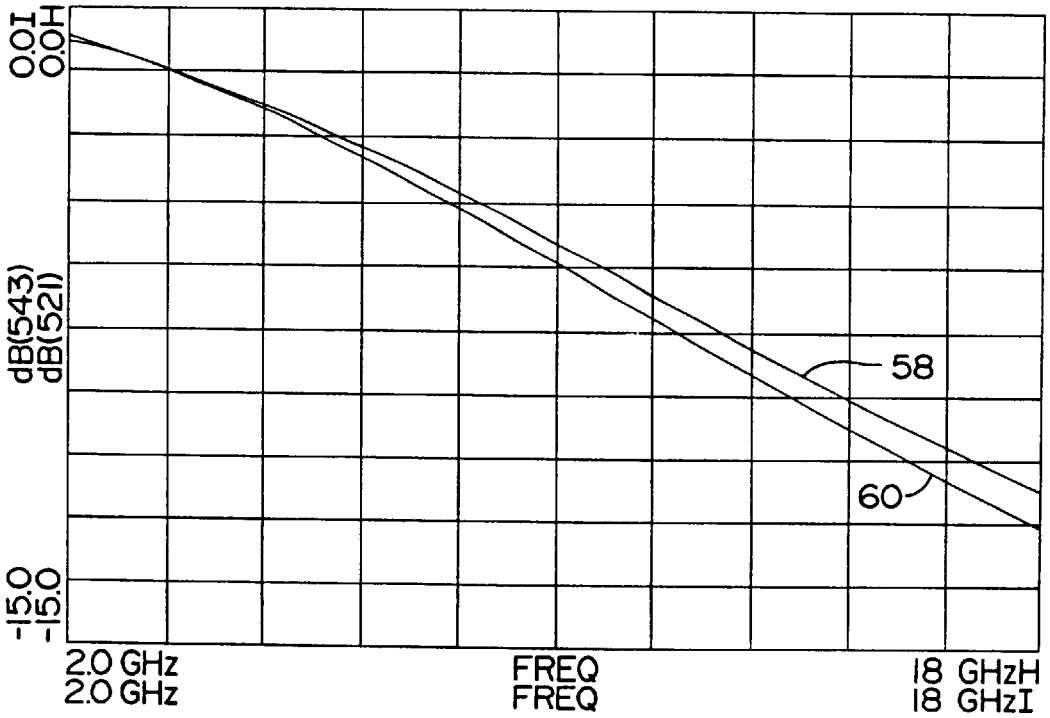
FIG 9

ULTRA WIDEBAND FREQUENCY DEPENDENT ATTENUATOR WITH CONSTANT GROUP DELAY

FIELD OF THE INVENTION

This invention relates to time delay circuits, and more particularly to an ultra wideband frequency dependent attenuator with a constant, group delay capable of simulating the loss of a long delay line in a shorter length delay component.

BACKGROUND OF THE INVENTION

Time delays are often realized in electronic systems with transmission lines of controlled length. The delay arises from the finite speed of electrical signals in the line. Different delays are often created by switching between a number of different delay lines having different lengths. Electronic systems employing delay lines include pulse generators, integrators, correlators, high speed samplers and sampling oscilloscopes, radar systems, phased array antennas and other communications systems.

A particular problem associated with switchable delay lines is that the longer the desired time delay (i.e., the longer the physical length of the delay line), the greater the loss becomes in the delay path. This is because of normal resistive losses in the metal and dielectric materials of the transmission line. The loss is almost always a function of frequency, with higher losses at higher frequencies being experienced. This characteristic of increasing loss with frequency is primarily the result of changing skin depth in the metal. When a switch is made between a short line and a longer delay line, the loss in the signal path changes. More specifically, the loss that will be experienced will be greater for the longer delay line.

The change in loss for different delays is a problem because an electronic system which is receiving signals passing through a plurality of different delay lines is often performing a summing action on the many signals, as in the case of a phased array antenna. The vector addition will be incorrect if the amplitudes of the signals vary significantly across different delay settings. Amplitude differences are also a problem in systems where a difference or other comparison between signals through different delay lines is required.

Any scheme to correct the loss occurring when a signal travels through a given delay line must also provide a constant time delay for all of the frequency components required for the system. If the constant time delay is not maintained, the electronic system which receives the signals passing through the time delay lines will have difficulty propagating pulses without distorting their shapes. This is because the high frequency components of the signals will suffer a phase change different from the low frequency components of the signals. The derivative of phase with respect to frequency is known as group delay. Extremely broadband communications systems including phased array antennas will have trouble meeting their specifications over the required bandwidth if the time delay is not constant for all frequencies of operation. This amounts to a requirement for constant group delay.

One approach to solving the above problem of different losses being experienced in a given signal depending upon the frequency of the given signal would be to eliminate the loss in the lines by employing a superconducting medium. Another approach would be to create a compensating attenuator circuit which can add loss to the shorter paths. These networks can be designed like a filter to have either increasing or decreasing loss at higher frequencies. The problem with superconducting media, however, is that they must be cooled to very low temperatures to operate. This increases the expense and power requirements for a system, in addition to reducing its reliability. The problem with the attenuating filter approach is that of bandwidth. It is very difficult, if not impossible, to design an attenuating filter which will maintain a constant group delay and desired attenuation characteristic over multiple octaves.

Accordingly, it would be highly desirable to provide a delay line in the form of an attenuating component which could be used in a bank of delay lines to provide a predetermined, constant time delay (i.e., phase delay with respect to frequency), and also which has a controlled loss (i.e., a loss which varies as a function of the frequency of the signal component passing therethrough) and a constant group delay. Such an attenuating circuit could be used to simulate the loss of a much longer delay line, while still providing a constant, shorter predetermined time delay.

SUMMARY OF THE INVENTION

The present invention is directed to an ultra wideband compensating attenuator intended for use as one delay line component in a plurality of banks of delay lines. The attenuator of the present invention provides a loss which can be matched to that of a different delay line having a much longer physical length, but which still provides a constant, much shorter time delay than the just-mentioned longer delay line. Thus, the attenuator of the present invention makes it possible to provide for equal loss through each one of a plurality of delay lines having different physical lengths, while still providing for shorter, yet constant time delay levels in accordance with the physical lengths of each of the attenuator components.

When the attenuator of the present invention is used in a circuit comprising at least one other delay line and a suitable switch for routing an input signal through either the delay line or the attenuator, the present invention makes it possible to provide for equal loss regardless of which path the input signal is routed. While this loss is still frequency dependent, the short time delay through the attenuator of the present invention provides exactly the same loss behavior as the longer delay line and maintains a nearly constant group delay.

The attenuator of the present invention is formed by placing a conventional (i.e., "ordinary") microstrip transmission line in series with an engineered lossy microstrip line. While the conventional microstrip line has a group delay that increases with frequency, the engineered lossy microstrip line, conversely, has a group delay which decreases with frequency. When the two types of transmission lines are placed in series, the group delay changes can be made to effectively cancel each other over an extremely wide frequency range.

In one preferred form of the present invention, the attenuator comprises an engineered lossy line having a resistive material deposited along at least one longitudinal edge of a microstrip conductor to provide a predetermined degree of additional resistance to the conductor. In various preferred embodiments, this resistive material can be formed with a plurality of spaced apart, conductive metallic "tracks" to tailor (i.e., tune) the loss of the engineered lossy microstrip transmission line to achieve a desired degree of constant loss and/or constant time delay. The present invention thus makes it possible to duplicate a loss which increases with frequency, but does so over a much shorter physical length than a conventional delay line having a longer physical length.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 2 is a highly enlarged, perspective view of a portion of a distributed compensating attenuator in accordance with a preferred embodiment of the present invention; and FIG. 3 is a highly enlarged plan view of a portion of just the lossy microstrip line portion of the apparatus of FIG. 2 illustrating one preferred form of resistive strips formed along opposing longitudinal edges of the microstrip element thereof;

FIG. 4 is a highly enlarged plan view of an alternative preferred form of the lossy microstrip transmission line of the present invention illustrating resistive strips along the opposing longitudinal edges of a microstrip element thereof, wherein each of the resistive strips includes a plurality of spaced apart metallic tracks;

FIG. 6 is a graph showing the increase in group delay relative to increasing frequency, of a signal travelling through an ordinary microstrip line;

FIG. 7 is a graph showing the simulated and measured increasing loss with frequency of a signal travelling through an ordinary microstrip line;

FIG. 8 is a graph showing the decrease in group delay, relative to frequency of an engineered, lossy microstrip transmission line; and FIG. 9 is a graph showing the simulated and measured decreasing loss with frequency of a signal travelling through a lossy microstrip line.

DETAILED DESCRIPTION OF THE PREFERRED EMBODIMENTS

The following description of the preferred embodiment(s) is merely exemplary in nature and is in no way intended to limit the invention, its application, or uses.

Figure 1:
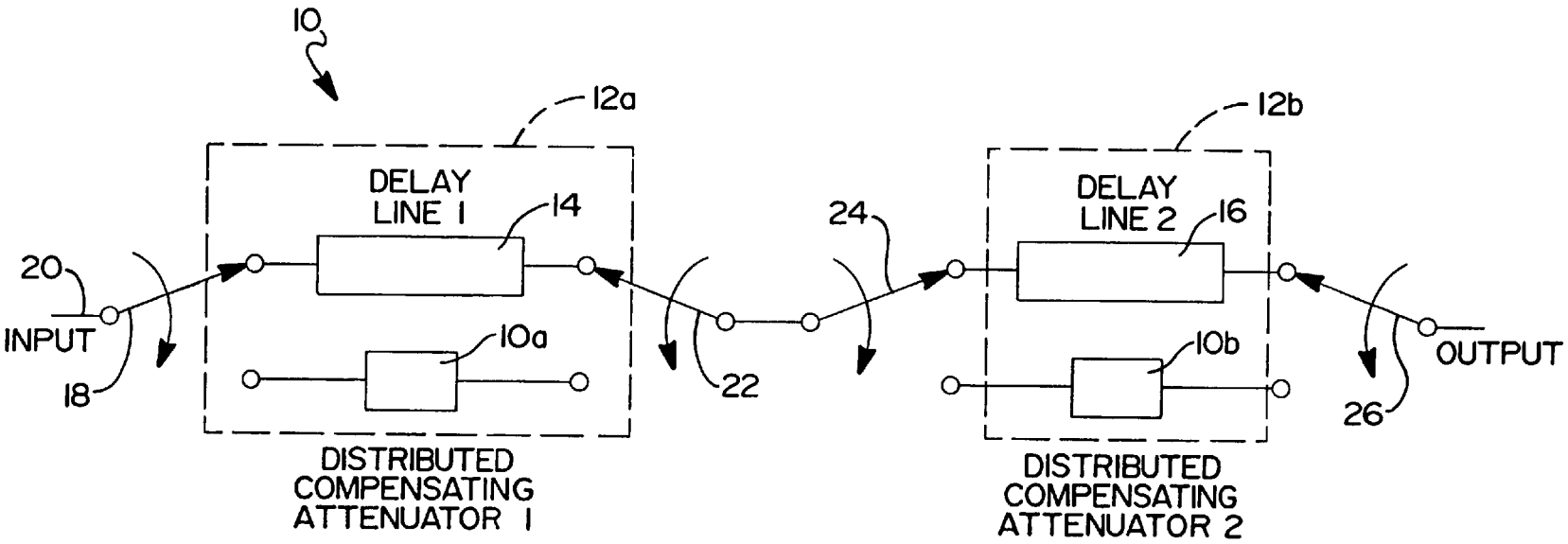
FIG. 1 is a simplified schematic drawing of a switching circuit incorporating a distributed compensating attenuator in accordance with a preferred embodiment of the present invention, in each one of a pair of levels of a two level time delay system.

Referring to FIG. 1, there are shown a pair of distributed compensating attenuators 10*a* and 10*b* in accordance with a preferred embodiment of the present invention. The attenuators 10 form a portion of a delay circuit 12 having two distinct delay levels 12*a* and 12*b*. It will be appreciated that attenuators 10*a* and 10*b* may be of identical construction or may be constructed to provide different loss and delay characteristics.

A first delay line 14 having a physical length longer than attenuator 10*a* forms the first delay level 12*a* of the system while a delay line 16, in association with attenuator 10*b*, forms the second delay level 12*b*. A first switch 18 routes an input signal applied to line 20 through either the first delay line 14 or the attenuator 10*a*. A second switch element 22 and a third switch element 24, movable independently of each other, are used to route the input signal from the first delay level 12*a* into either the second delay line 16 or attenuator 10*b*. A fourth switch 26 allows the signal to exit from either the second delay line 16 or attenuator 10*b* depending upon the position of switch 24.

In brief, each of the attenuators 10*a*, 10*b* operate to provide a loss which is "matched" to the loss of its associated, but longer in physical length, delay line 14 or 16. However, since the attenuators 10*a* and 10*b* are each shorter in length than their associated delay lines 14 or 16, the time delay which the input signal experiences when traveling through each attenuator 10*a* or 10*b*, is shorter than the time delay experienced when traveling through either of delay lines 14 or 16. In this manner, the attenuator 10 is able to simulate the loss characteristic of a longer length delay line while still providing a shorter time delay. Furthermore, while only two delay levels 12*a* and 12*b* are illustrated in FIG. 1, it will be appreciated that a greater or lesser number of delay levels may be formed, and therefore that the circuit 12 making use of the attenuators 10*a*, 10*b* is not limited to only a two level delay system.

The attenuator 10 of the present invention provides a controlled, frequency dependent loss, but this loss can be tailored or "tuned" to match the physically longer delay line with which the attenuator 10 is associated. Thus, for example, the loss to the input signal through the first delay element 14 or attenuator 10*a* will be the same even though the attenuator 10*a* provides a much shorter time delay than first delay line 14. Furthermore, the loss to the signal experienced when passing through the first delay level 12*a* can thus be made to be identical to the loss of a signal when it passes through the second delay level 12*b*, regardless of the position of any of the switches 18, 22, 24 or 26.

While it may be desirable in some electronic systems to eliminate the frequency dependent loss, even though the attenuator 10 of the present invention provides a constant for any value of delay, this could be provided by a separate compensating circuit or adjustable gain control loop. The compensating circuit or adjustable gain control loop could provide this function at a point in a given system before, after or distributed within one of the delay levels 12*a* or 12*b* of the circuit of FIG. 1.

Referring to FIG. 2, a highly enlarged view of a portion of the attenuator 10 of the present invention is illustrated. The goal of providing a controlled loss as a function of frequency, with a constant, group delay, is realized by providing a length of a conventional (i.e., ordinary) microstrip line 28 in series with an engineered lossy microstrip transmission line 30. The transmission lines 28 and 30 are provided on a substrate, such as a dielectric substrate 31, which in turn is formed on a metallic ground plane 33.

It will be appreciated that all conventional microstrip lines have a time delay which tends to increase with frequency. This is a natural characteristic of such a conventional microstrip transmission line and is a consequence of the fact that microstrip elements support multiple simultaneous propagating modes of electric and magnetic field distributions, and that the proportion of energy in each mode changes with frequency. Conversely, engineered lossy microstrip transmission lines have a group delay which tends to decrease with frequency. When the two types of transmission lines are placed in series, the group delay changes can be made to effectively cancel each other over an extremely wide frequency range. Thus, by using the typically undesirable property of increasing group delay of a conventional microstrip transmission line in series with the characteristics of an engineered lossy microstrip transmission line, there can be achieved a nearly constant group delay through the attenuator 10 over an ultrawide frequency band.

With reference to FIGS. 2–4, the construction of the engineered lossy microstrip transmission line 30 of the attenuator 10 will now be described. Initially, it should be understood that to duplicate the loss in a given, long delay line, there will be needed a loss which increases with frequency but which does so over a much shorter distance than the length of the given delay line. The electric current in a conventional microstrip line, such as microstrip transmission line 28, tends to move out toward each longitudinal edge 28*a* thereof (FIG. 2) as frequency increases. To increase the loss provided by the attenuator 10, as a function of frequency, resistive strips of material 32 (FIG. 3) are placed at each longitudinal edge 30*a* of the lossy microstrip transmission line 30. Preferably, these resistive strips 32 each comprise a low resistivity material and may have a resistance of as little as about 2.5 ohms/square at each longitudinal edge 30*a* of the transmission line 30. They may be formed from copper or another suitably conductive material. However, since it is difficult to obtain resistivities this low in most commercial manufacturing processes, a second method involves using material having a much greater resistivity at opposing longitudinal edges 30*a*. Such an embodiment is shown in FIG. 4. FIG. 4 illustrates an alternative, lossy microstrip transmission line 34 having opposing longitudinal edges 34*a* which is placed on the dielectric substrate 31. Each opposing longitudinal edge 34*a* is covered by a resistive strip of material 36 having a resistivity much greater than that of the resistive strips 32 illustrated in FIG. 3. In one preferred form, the resistivity of each of resistive strips 36 is about 50 ohms/square. Each of the resistive strips 36 further includes a plurality of elongated metallic tracks laid thereover which may be formed from copper or another highly electrically conductive material. The length 40 of each metallic track 38 is important for providing the desired degree of resistivity. In one preferred form, the length 40 of each metallic track 38 is much less than a wavelength. It has been discovered that the frequency at which the increased loss becomes most effective, with the resistive strips 36, is dependent on the length of each of the metallic tracks 38. Still further, it has been determined that the longer the length of each of the metallic tracks 38, the more effective at low frequency the lossy transmission line 34 becomes. The shorter the metallic tracks 38, the more effective at high frequency the lossy transmission line 30 becomes.

Figure 5:
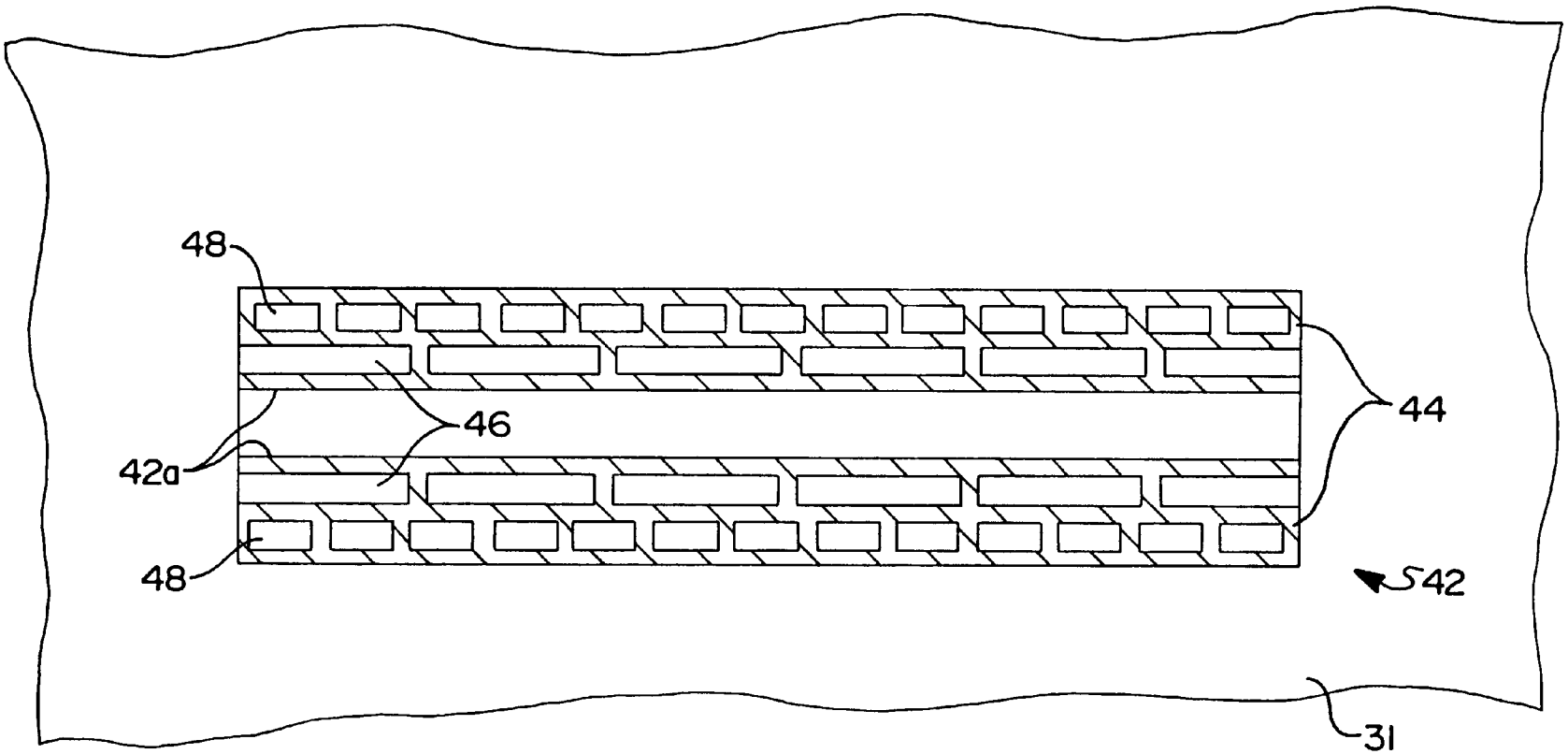
FIG. 5 is a highly enlarged plan view of still another alternative preferred form of a microstrip element of the lossy transmission line of the present invention illustrating still another pattern of metallic tracks having different lengths to provide particular loss characteristics thereto.

With the above characteristics in mind, another alternative preferred embodiment of the engineered lossy microstrip transmission line portion of the attenuator 10 is shown in FIG. 5 and indicated by reference numeral 42. The lossy microstrip transmission line 42 makes use of the above known characteristics by providing a pair of resistive strips 44 at opposing longitudinal edges 42*a* thereof, wherein each of the resistive strips of material 44 include not only long, spaced apart metallic tracks 46 but shorter, spaced apart metallic tracks 48 disposed closely adjacent the longer metallic tracks 46. This allows the designer to "tune" up the increasing loss that a signal traveling through the lossy microstrip transmission line 42 experiences as a function of frequency. However, multiple rows of metallic tracks can produce non-linear time delay functions with frequency that are not easily compensated for by ordinary microstrip transmission lines over as broad a frequency range.

Referring now to FIG. 6, the measured and full wave electromagnetically simulated results for an ordinary microstrip line, such as transmission line 28 in FIG. 2, is shown. Waveform 50 represents a measured time delay of an ordinary microstrip line having a width of 10 mills (0.254 mm), 930 mills in length (23.62 mm) and printed on a 10 mill (0.254 mm) thick Alumina substrate. Line 52 indicates the simulated, positive going trend of the group delay.

FIG. 7 illustrates the increasing measured loss 53*a* with frequency, and the simulated loss 53*b* of the ordinary microstrip line.

Referring to FIG. 8, the measured and full wave simulated results for a lossy microstrip transmission line similar to the lossy transmission line 30 in FIG. 2 are illustrated. Waveform 54 represents the measured group delay while line 56 represents the simulated group delay. From FIG. 8, the opposite going negative trend in the simulated and measured group delay can be clearly seen. The frequency dependent loss is also greatly increased over the ordinary microstrip transmission line 28. FIG. 9 illustrates the measured loss 58 and the simulated loss 60 of similar to that provided by the lossy transmission line 30. The measured results illustrated in FIGS. 6 and 8 illustrate the characteristics of a component having increased loss and constant group delay over an extremely broad frequency range with a cascade or series of lossy and ordinary microstrip lines. The proportion of length in lossy and ordinary microstrip transmission lines for each combination thereof need only be adjusted to achieve the required attenuation and the desired, constant group delay characteristic. In all cases the length of the attenuator 10 of the present invention will be significantly shorter than the delay line being compensated for, so that a switchable step in delay is possible with the same attenuation as a function of frequency.

A principal advantage of the present invention is therefore that it provides a method for creating a loss like that of a long delay line in a short line, yet with a constant group delay.

The attenuator 10 can be fabricated in standard, low cost, lightweight, planar technologies including thin film metallization on ceramic or other substrates. The method is compatible with monolithic microwave integrated circuit (MMIC) and other integrated circuit technologies. The apparatus 10 thus forms a component ideally suited for use in highly precise, extremely broadband time delay systems. It is anticipated that the attenuator 10 will find utility in advanced radar in communication systems as well as certain types of test equipment. Specific applications where the apparatus 10 is expected to find particular utility are in connection with phased array antennas, pulse generators, pulse radar systems, sampling oscilloscopes and sampling frequency convertors.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An apparatus for providing a pair of different group delays to an input signal while a frequency dependent loss in the magnitude of the input signal remains constant, regardless which one of a pair of paths said input signal takes, the apparatus comprising:

a first delay component providing a first group delay to said input signal if said input signal is routed therethrough and a first frequency dependent loss to said input signal;

a second delay component providing a second group delay which is shorter than said first time delay, but which has a second frequency dependent loss approximately equal to said first frequency dependent loss with substantially constant group delay; and a switch for selectively routing said input signal through either one of said first or second delay components depending on a degree of time delay desired to be imparted to said input signal;

wherein at least one of said first delay component and said second delay component includes a microstrip transmission line.

2. The apparatus of claim 1, wherein said second delay component comprises a hybrid transmission line including an ordinary microstrip transmission line placed in series with a lossy microstrip transmission line.

3. The apparatus of claim 2, wherein said lossy microstrip transmission line comprises a microstrip conductor having a pair of resistive strip of material deposited along opposing longitudinal edges of said microstrip conductor.

4. The apparatus of claim 3, wherein each one of said resistive strips of material comprises a resistance of about 2.5 ohms/square.

5. The apparatus of claim 3, wherein each one of said resistive strips of material comprises a plurality of overlaid sections of metallic material forming metallic tracks spaced generally evenly therealong.

6. The apparatus of claim 5, wherein each one of said resistive strips comprises a resistance of approximately 50 ohms/square.

7. An apparatus for providing a desired switchable time delay at a constant loss to an input signal, the apparatus comprising:

a first time delay line providing a first time delay;

a second time delay line including a hybrid microstrip transmission component which provides a second time delay shorter than said first time delay, and which has a physical length shorter than said first time delay line, and a frequency dependent loss matching a loss of said first time delay line with substantially constant group delay; and a switch for selecting one of said delay lines, depending on a desired time delay to be applied to said input signal, to thereby route said input signal through a selected one of said delay lines so as to achieve said desired time delay of said input signal.

8. The apparatus of claim 7, wherein said hybrid microstrip transmission component comprises a length of an ordinary microstrip transmission line in series with a length of an engineered lossy microstrip transmission line.

9. The apparatus of claim 7, wherein said engineered lossy microstrip transmission line is tuned to provide a desired loss characteristic.

10. The apparatus of claim 9, wherein said engineered lossy microstrip transmission line comprises a microstrip transmission element having opposing longitudinal edges, wherein resistive material is placed along at least one of said opposing longitudinal edges to provide said desired loss characteristic.

11. The apparatus of claim 9, wherein resistive material is placed along both of said opposing longitudinal edges of said microstrip transmission element.

12. The apparatus of claim 11, wherein said resistive material along at least one of said opposing longitudinal edges includes a plurality of spaced apart slots devoid of resistive material and filled with a metallic material to form metallic tracks.

13. A method for forming a compensated attenuator for providing a desired degree of loss and a desired degree of time delay to an input signal fed thereinto, said method comprising the steps of:

forming a first delay line from a length of ordinary microstrip transmission line, said first delay line having a first loss characteristic;

forming a second delay line from a length of engineered lossy microstrip transmission line having a second loss characteristic that is different than said first loss characteristic; and placing said first and second delay lines in series with one another to effectively form a single, continuous microstrip transmission line having said desired degree of loss and said desired degree of time delay with a substantially constant group delay.

14. The method of claim 13, further comprising the step of forming each of said ordinary microstrip transmission line and said engineered lossy microstrip transmission line on a substrate.

15. The method of claim 13, wherein the step of forming said second delay line comprises the step of placing a strip of resistive material along at least one longitudinal edge of said engineered lossy microstrip transmission line.

* * * * *